US006366869B1

(12) United States Patent
Germain

(10) Patent No.: US 6,366,869 B1
(45) Date of Patent: Apr. 2, 2002

(54) ROLLING CIRCLE

(76) Inventor: Shylov F. Germain, 2925 NW. 116th Ter., Coral Springs, FL (US) 33065

( * ) Notice: Subject to any disclaimer, the term of this patent is extended or adjusted under 35 U.S.C. 154(b) by 0 days.

(21) Appl. No.: 09/243,404

(22) Filed: Feb. 1, 1999

(51) Int. Cl.[7] ..... A63H 33/02
(52) U.S. Cl. ..... 702/160; 446/453; 482/8
(58) Field of Search ..... 702/158, 160, 702/161, 164, 165; 482/3, 7, 8, 14; 446/450, 453

(56) References Cited

U.S. PATENT DOCUMENTS

| | | | | | |
|---|---|---|---|---|---|
| 2,979,860 | A | | 4/1961 | Baita | 46/220 |
| 3,758,984 | A | * | 9/1973 | Spransy et al. | 46/220 |
| 4,085,541 | A | | 4/1978 | Mapp | 46/228 |
| 4,102,077 | A | | 7/1978 | Marino | 46/220 |
| 4,148,153 | A | | 4/1979 | Phillips, Jr. | 46/220 |
| 4,173,384 | A | | 11/1979 | Hensley | 46/220 |
| 4,304,067 | A | | 12/1981 | Petrosky | 46/220 |
| 4,861,310 | A | | 8/1989 | Hemenway | 446/453 |
| 4,897,069 | A | * | 1/1990 | Overturf | 446/219 |
| 4,911,675 | A | | 3/1990 | Rogers | 446/267 |
| 4,917,650 | A | * | 4/1990 | Paultre | 446/453 |
| 5,299,970 | A | | 4/1994 | Fontaine | 446/453 |
| 5,383,826 | A | * | 1/1995 | Michael | 482/3 |
| 5,586,957 | A | * | 12/1996 | Wilkinson | 482/74 |
| 5,730,639 | A | | 3/1998 | Harding | 446/453 |
| 5,893,817 | A | * | 4/1999 | Morgan | 482/8 |
| D442,094 | S | * | 5/2001 | Seo | D10/65 |

* cited by examiner

*Primary Examiner*—Patrick Assouad
(74) *Attorney, Agent, or Firm*—Joseph N. Breaux

(57) ABSTRACT

A recreational and exercise device which includes electronic features added to a rolling circle game including a liquid crystal display of the time, distance traveled, speed of travel, and the user's pulse rate. The device includes a open hard rubber circle captureable with a hook member attached to a distal end of a stick, while a handle is provided on a proximal end of the stick. A magnet is secured within the circle and a magnetic sensor is mounted near the hook member so that as the circle rotates while captured within the hook member the passing of the magnet by the magnetic sensor sends a signal to a processor which then displays the speed and distance on a LCD mounted on a top flat portion of the handle. A pulse detector is also provided in the handle portion for detecting the pulse rate of the user while an internal timer and power supply are also provided.

5 Claims, 6 Drawing Sheets

ROLLING CIRCLE

TECHNICAL FIELD

The present invention relates to recreational toys and more particularly to a rolling circle which includes a hard rubber rolling circle, an extendable stick with a looped end for capturing the circle, and an electronic speed, distance, heart rate, and timer placed within the handle of the extendable stick.

BACKGROUND ART

The concept of a rolling circle amusement device and recreational toy has been subject of numerous patents over many years. A significantly improved rolling circle recreational toy was patented in 1908 by E. F. Draper, U.S. Pat. No. 932,451. Since his patent date numerous rolling devices and rolling circles have been invented including the following: J. A. Barta, U.S. Pat. No. 2,979,860, Marino, U.S. Pat. No. 4,102,077, Hensley, U.S. Pat. No. 4,173,841, Hemenway, U.S. Pat. No. 4,861,310, Fontaine, U.S. Pat. No. 5,299,970, Harding, U.S. Pat. No. 5,730,639, Rogers, U.S. Pat. No. 4,911,675, Petrosky, U.S. Pat. No. 4,304,067, Mapp, U.S. Pat. No. 4,085,541, Phillips, Jr., U.S. Pat. No. 4,148,153. The prior art rolling circles, sometimes called rolling wheels or hoop, are all very useful improvements for their stated purposes. Despite the numerous improvements, there has never been a rolling circle and/or wheel as the present invention which includes numerous electronic information features including a means for monitoring the user's heart rate, speed of walking and/or jogging, distance, a stop watch and/or timer.

The present invention adds numerous dimensions to the recreational toy and rolling circle allowing a person to not only derive recreational use and enjoyment from the rolling circle but also monitor the user's heart rate, speed of travel, and distance.

GENERAL SUMMARY DISCUSSION OF INVENTION

It is thus an object of the invention to provide a rolling circle that includes a hard rubber open rolling circle captured by a hooked end portion of an extendable stick with a handle end fitted with an LCD electronic data read out indicating the user's heart rate, speed of travel, distance traveled, a timer, and clock.

It is a further object of the invention to provide a rolling circle that not only provides a recreational toy for the user but also an electronic monitor to determine the user's heart rate, in addition to distance and speed traveled along with a timing device for measuring intervals of time.

Accordingly, a rolling circle is provided which includes a hard rubber circle captured by a hook member attached to an extendable stick wherein the handle portion of the stick includes a sensor for detecting the pulse rate of the user gripping the handle, and further including timing circuitry and a magnetic revolution counter positioned near the hook member which includes a magnet that is insertable and securely positioned within the hard rubber circle so that as the circle rotates while captured within the hook member the passing of the magnetic sensor by the magnetic revolution counter sends an electronic signal to electrical circuitry in the handle which indicates the speed and distance traveled and displays such to the user on an LCD read out positioned on a top portion of the handle of the extendable stick.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the preceding description that in use, the rolling circle with the numerous electronic features would be utilized by anyone while jogging, running, walking, playing, or any other activity desired by the user. The user would hold the handle of the extendable stick in one hand and place the hard rubber circle in the hooked member mounted to the distal end of the stick and then begin rolling the circle. The user would continue to push the circle with the stick while walking or jogging. As the circle rotates while captured by the hook member, a magnet which is positioned on the circle passes a magnetic sensor located near the hook member. The passing of the magnet across the sensor sends an electrical signal through electrical circuitry to the handle where a processor displays the users speed and distance traveled. The electrical circuitry also includes a timer which is incrementally setable for timing intervals and also includes a pulse sensor positioned on the handle portion so that when the user grips the handle the user's pulse rate is also calculated and displayed on an LCD read out positioned on a top portion of the handle. The LCD screen and the handle would allow the user to keep track of his/her workout and track his/her pulse rate and/or speed and distance traveled as desired. Use of the rolling circle provides a number of games for any age of user in addition to a distance measuring means and speed measuring means for the user so that he/she may keep track of distance for exercise purposes.

Figure 1:
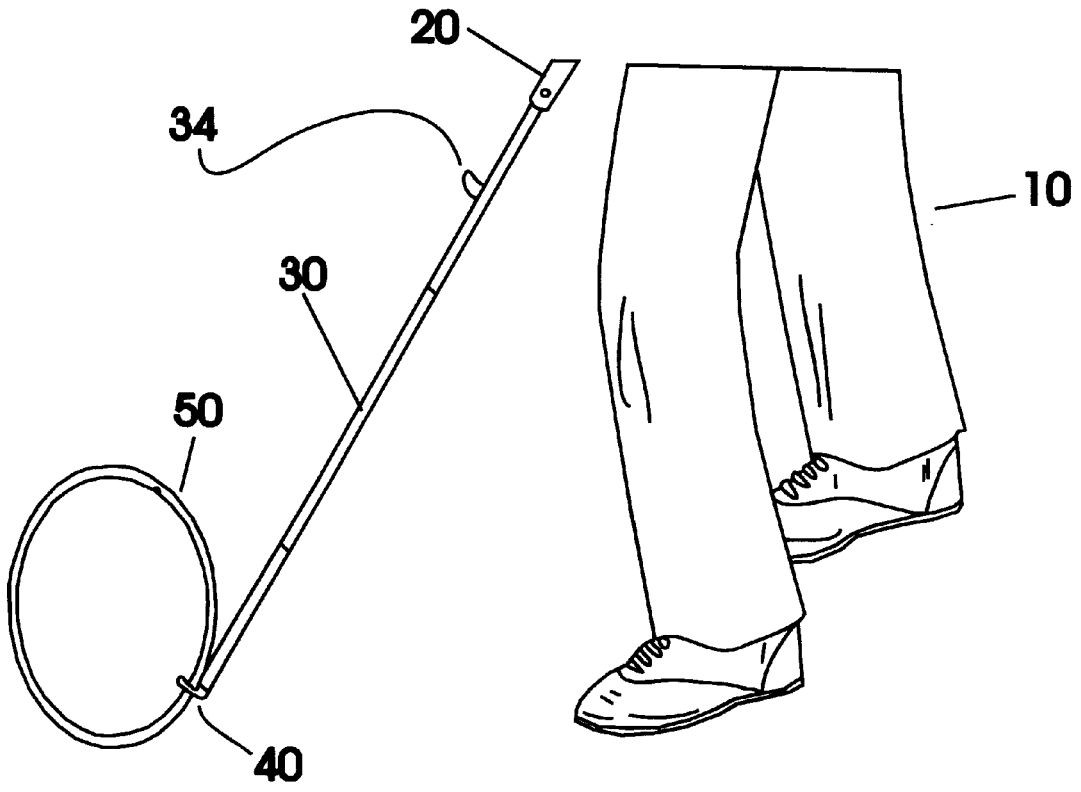
FIG. 1 is a side view of a user holding the extended stick with a hooked member capturing the rolling circle.
Figure 2:
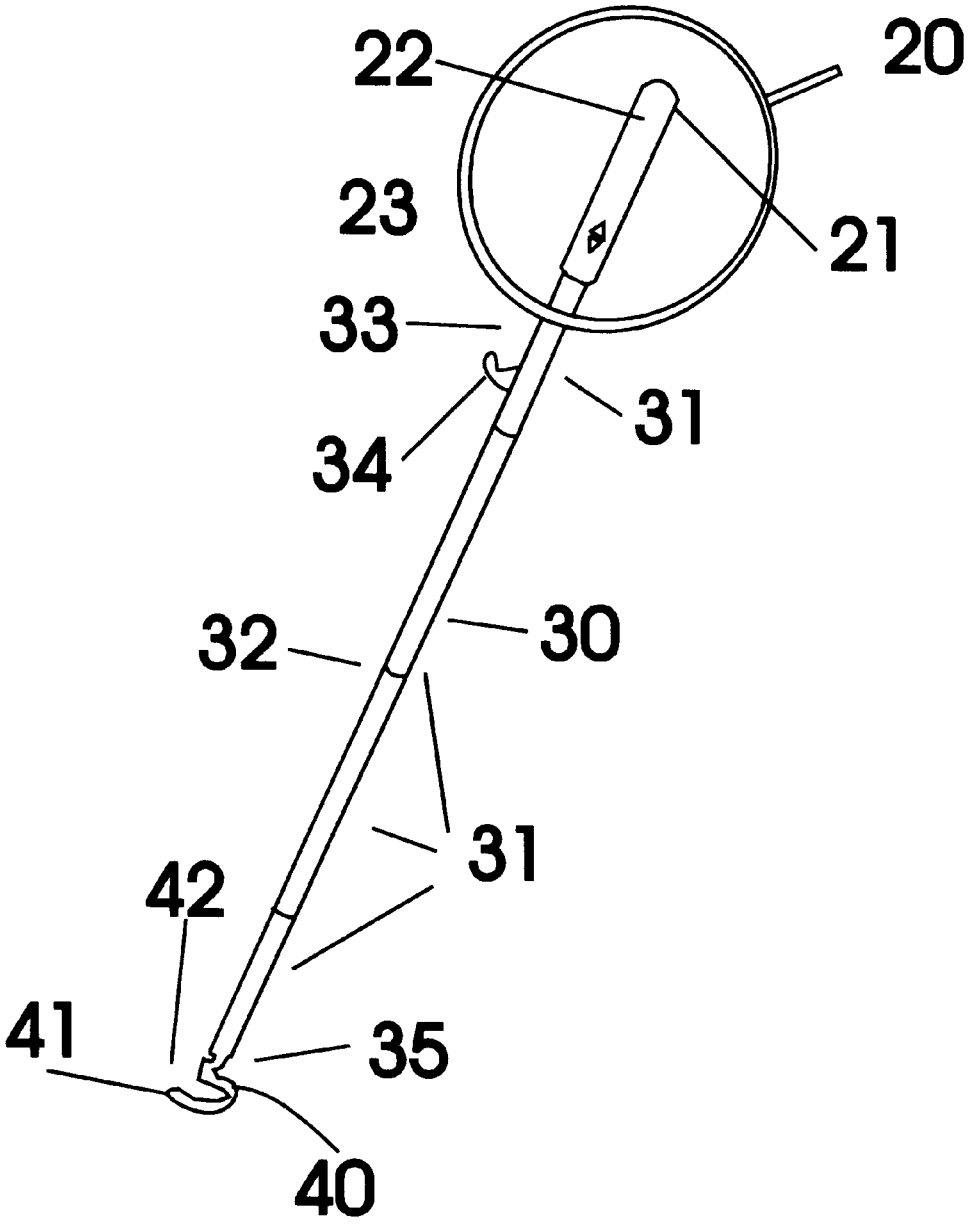
FIG. 2 is an isolated view of the extendable stick with hooked end and handle end displayed.

Referring to the figures in detail, FIG. 1 illustrates a user 10 grasping the handle portion 20 mounted to a proximal end of the extended stick 30 which includes a hook member 40 attached to a distal end of the stick which is used to capture the hard rubber circle 50. FIG. 2 illustrates the stick 30 in detail which includes four longitudinal length sections 31 which are joined by inserting each section together forming joints 32 which are secured by screws and which are succeedingly small from the proximal end to the distal end. The proximal end 33 of the stick includes a handle 20 with a top cap 21 grip portion 22 and an electric on/off switch 23. The stick 30 includes an upturned receiving hook 34 which is used to hold and store the hard rubber circle 50 temporarily when the user desires to not roll the circle on a playing surface. A distal end of the stick 35 provides a connection area for the hook member 40. The stick 30 is preferably constructed of light weight durable material such as aluminum tubing, or any polymer material which would be suitable for constructing the tubes. The sections 31 are connected utilizing a male/female connection type joint while a screw secures the joints in place.

The hook member 40 is attached to the distal end of the stick 35 by either press fit or adhesives and furthermore may be integrally formed as a part of the distal section of the stick. The hook member 40 includes a resilient hook finger 41 that extends from a connecting portion 43 and defines a central area 44 for maintaining the captured circle 50. The end of the hook finger is separated from the connecting portion 43 to form an entry way 42 into central area 44 for inserting the circle 50.

The circle 50 is preferably constructed of a durable hard rubber material and has an open middle section and may be referred to as a hoop or wheel. The circle also includes an outer surface 52 which contacts the playing surface when the circle is in use, and an inner surface 53 which does not contact the playing surface. A magnet 54 is permanently mounted in the circle 50 and is preferably inserted into the material comprising the circle from the inner surface 53 so that the magnet 54 will not contact the playing surface while the circle is in use. The magnet 54 is also inserted partially through the cross section of the circle while a slight portion of circle material is maintained in the outer surface to provide for wear of the circle within contacting the magnet.

A magnet sensor 60 is mounted on a distal end of the extendable stick and further on a top surface of the hook member and in a position so that as the circle rolls, while captured in the hook member, the magnet on the circle passes the magnetic sensor on each revolution and is detected by the sensor. The magnetic sensor send an electrical signal each time the magnet passes on each revolution via electrical lead 61 which is positioned within an interior of the extendable stick.

Figure 3:
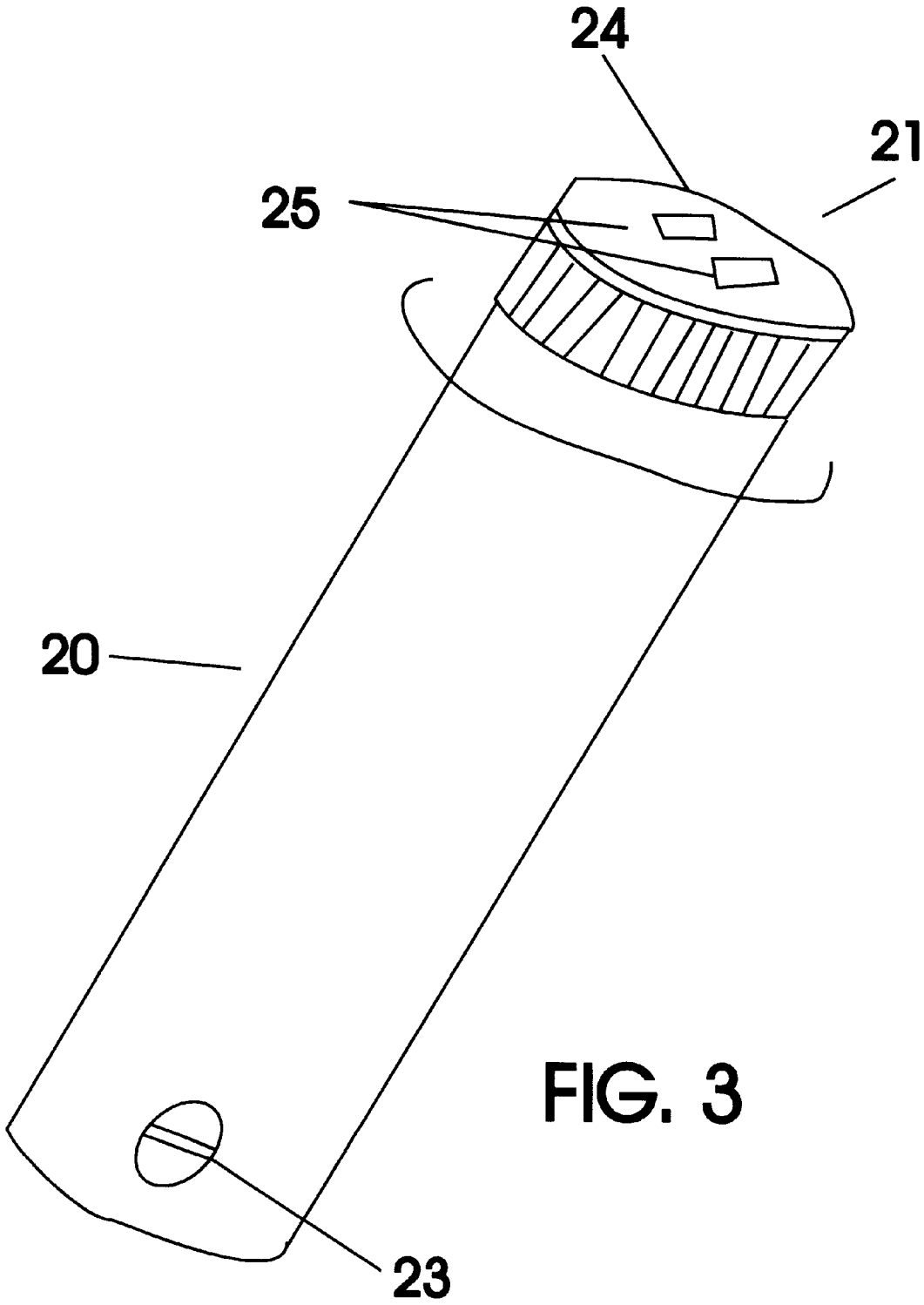
FIG. 3 is an isolated view of the handle positioned on the top end of the stick on FIG. 2.
Figure 4:
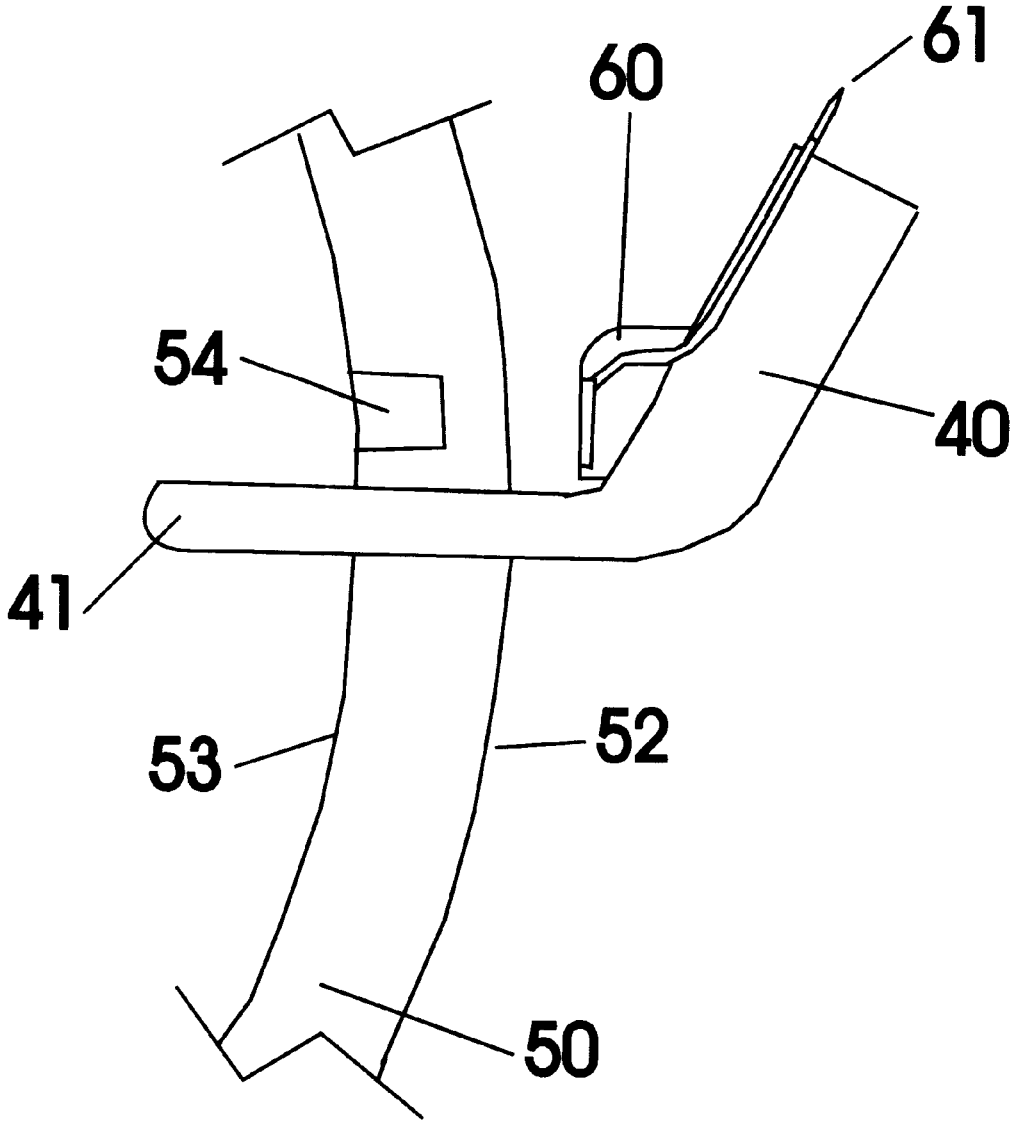
FIG. 4 is a close up side view of the hooked end of the stick in relation to the circle captured therein and the positioning of the magnetic sensor for indicating travel distance and travel speed.
Figure 5:
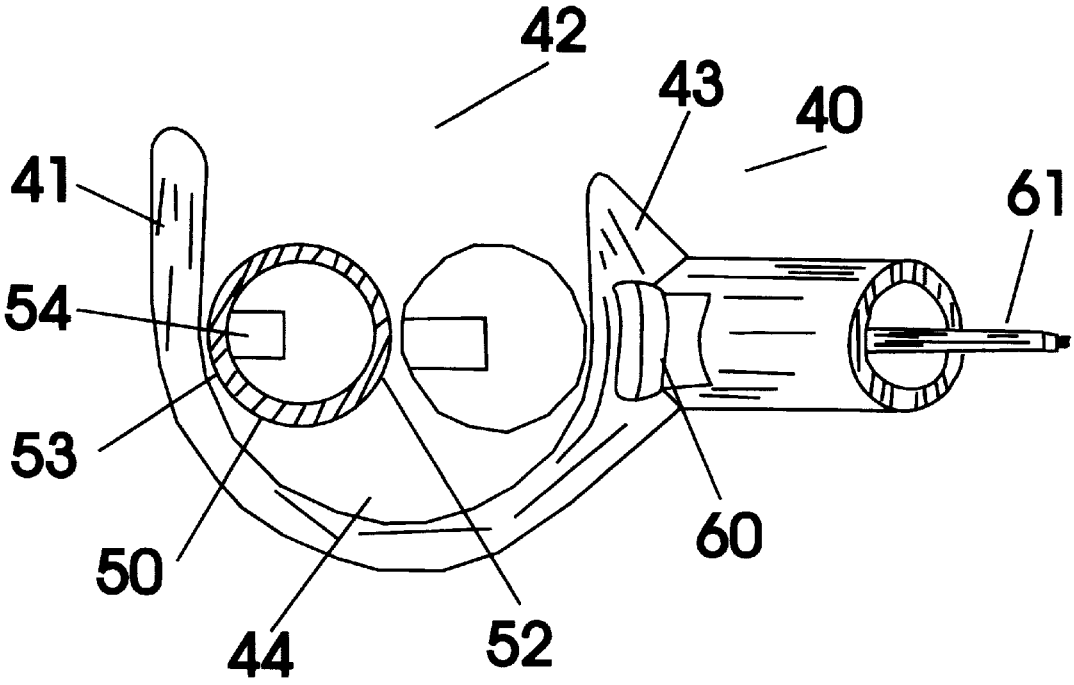
FIG. 5 is a top view of the looped end of the stick illustrating the positioning of the magnetic sensor and magnet positioned in the hard rubber circle captured therein.
Figure 6:
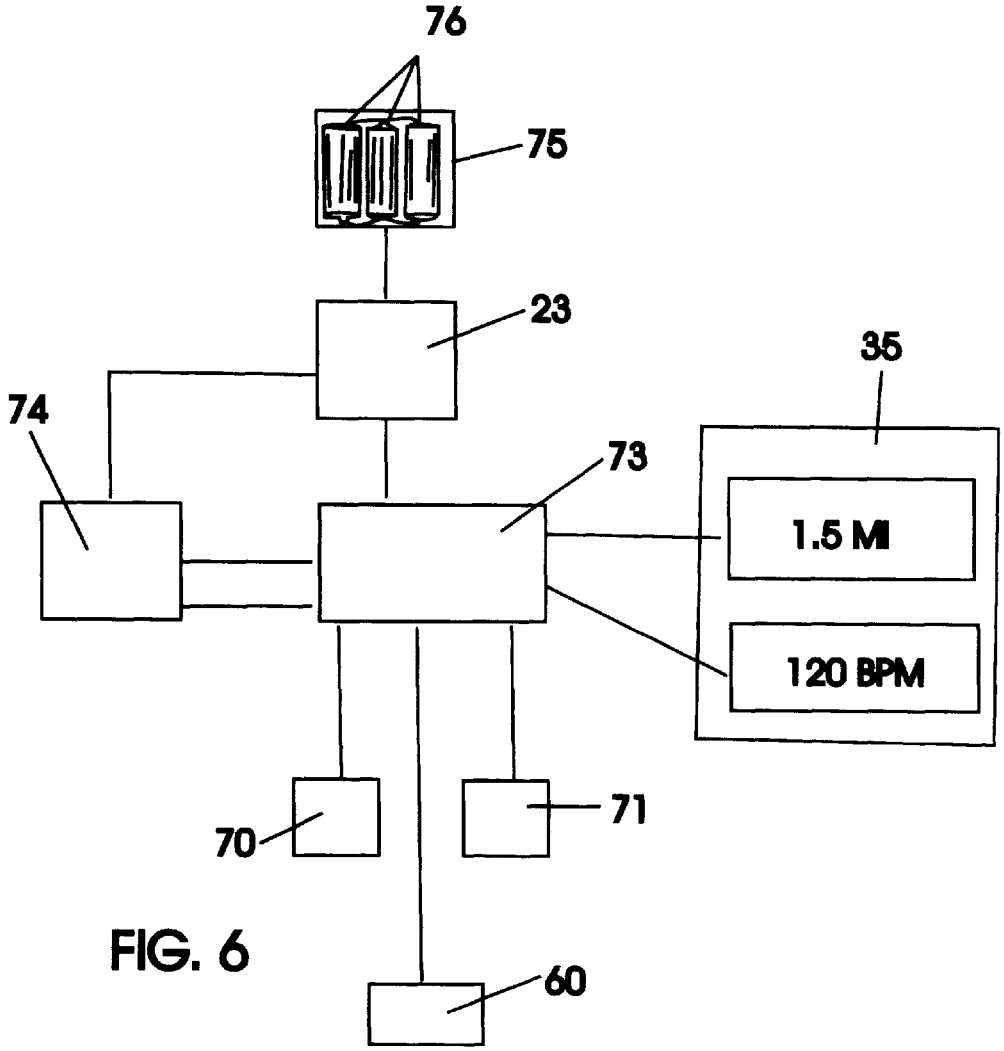
FIG. 6 is electrical circuitry for operating the timer, speed meter, distance meter, pulse rate meter and LCD display.

Referring to the handle portion in detail, FIG. 3 illustrates the handle 20 with the electronic on/off switch 23 mounted near a lower end of the handle while the cap portion of the handle 21 includes a liquid crystal display (LCD) 35 positioned on the top flat surface 24 of the cap 21. The LCD provides a means for indicating to the user the user's speed, distance travel, heart rate, time, or interval timing. The handle includes electronic circuitry which comprises an internal electronic timer 70, a pulse rate sensor 71 which is mounted within the handle gripping portion 22, a processor 73 for receiving the electrical input from the timer 70, pulse rate sensor 71, and magnetic sensor 60. The handle 20 also includes an accessible electronic switch 74 for allowing the user to switch between viewing time, speed, distance traveled, and pulse rate as desired and a power supply 75. FIG. 6 illustrates the basic electrical circuitry wherein the power supply 75 includes three AAA batteries 76 which are electrically connected to the on/off switch 23 and wherein the on/off switch 23 activates the both the processor 73 and the electronic selective switch 74. The processor receives electrical signals from the magnetic sensor 60, timer 70 and the pulse detector. The processor then, depending upon the positioning of the selective switch 74, displays information of the LCD 35. In FIG. 6 the information displayed is the user's beats per minute (BPM) and distance traveled. Other combinations of information may be displayed including information in different units.

It is noted that the embodiment of the rolling circle described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A rolling circle for both recreational and exercise use, comprising:

a) a hard rubber open circle having a round cross section and a outer surface which contacts a playing surface and an inner surface while a magnetic is permanently attached and positioned within the round cross section of the circle, b) an extendable stick with a proximal handle end and a distal end with a hook member attached thereto, c) the hook member having a resilient hook finger that extends from a connecting portion and defines a central area for receiving a portion of the open circle, an end of the resilient hook finger is separated from the connecting portion to form an entry way into the central area, d) a magnetic sensor is positioned adjacent to the distal end of the stick and near the hook member and is further positioned so that as the circle rotates while being captured in the central portion of the hook member the magnetic sensor creates an electrical signal each time the magnet on the circle passes the magnetic sensor, e) the proximal handle end further comprises a hand grip portion providing a comfortable gripping area for a user, a liquid crystal display mounted to a flat top portion of the handle, a user pulse rate detector mounted within the gripping area of the handle, and electrical circuitry mounted within the handle, f) the electrical circuitry further comprises a timer, a power supply, an on/off switch, and a processor which receives electrical signals from the magnetic sensor, pulse rate detector and timer and then selectively displays the time, user's speed, distance traveled, or pulse rate on the liquid crystal display.

2. The rolling circle of claim 1, wherein the magnet further comprises a magnet inserted into a receiving area on the inner surface of the circle and not extending through the cross section of the circle so that the magnet does not contact playing surface when the circle rotates.

3. The rolling circle of claim 1, wherein the extendable stick includes numerous longitudinal sections secured to each other which each such section from the distal end to the proximal end is succeedingly larger while the section which comprises the proximal end further comprises radially extending receiving hook for temporarily attaching the circle when the circle is not in use.

4. The Rolling Circle of claim 1, wherein the magnetic sensor is electrically connected to the processor.

5. The rolling circle of claim 1 wherein the processor and the electrical circuitry further comprises an electrical switch mounted to the handle end which allows a user to selectively switch from displaying time, distance traveled, speed of travel, pulse rate, and other mathematical manipulations of time, distance and pulse rate on the liquid crystal display.

* * * * *